US006556795B2

(12) United States Patent
Miyamura et al.

(10) Patent No.: US 6,556,795 B2
(45) Date of Patent: Apr. 29, 2003

(54) APPARATUS FOR CONTROLLING TONER CONCENTRATION IN AN ELECTROPHOTOGRAPHIC DEVICE

(75) Inventors: Hiroaki Miyamura, Tokyo (JP); Saeko Toda, Tokyo (JP); Tetsuo Tanda, Tokyo (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/848,782

(22) Filed: May 4, 2001

(65) Prior Publication Data

US 2001/0053293 A1 Dec. 20, 2001

(30) Foreign Application Priority Data

May 15, 2000 (JP) ..... 2000-141596
Aug. 11, 2000 (JP) ..... 2000-244436

(51) Int. Cl.[7] ..... G03G 15/08; G03G 15/10
(52) U.S. Cl. ..... 399/30; 399/62
(58) Field of Search ..... 399/30, 58, 61, 399/62, 63

(56) References Cited

U.S. PATENT DOCUMENTS

| | | | | |
|---|---|---|---|---|
| 4,901,115 A | | 2/1990 | Nakamura et al. | 399/63 |
| 4,956,669 A | | 9/1990 | Nakamura | 399/62 X |
| 4,974,025 A | | 11/1990 | Kikuchi | 399/63 |
| 5,036,363 A | * | 7/1991 | Iida et al. | 399/30 |
| 5,216,470 A | | 6/1993 | Asanuma et al. | 399/63 |
| 5,717,973 A | | 2/1998 | Endoh et al. | 399/29 |
| 6,148,156 A | * | 11/2000 | Matsumoto | 399/30 |
| 6,212,341 B1 | * | 4/2001 | Miyamura et al. | 399/63 X |

FOREIGN PATENT DOCUMENTS

| | | |
|---|---|---|
| JP | 63-106679 | 5/1988 |
| JP | 1-261683 | 10/1989 |
| JP | 2-64560 | 3/1990 |
| JP | 3-256082 | 11/1991 |
| JP | 7-306592 | 11/1995 |
| JP | 2000-112220 | 4/2000 |
| JP | 2000-112221 | 4/2000 |

* cited by examiner

*Primary Examiner*—Fred L Braun
(74) *Attorney, Agent, or Firm*—Hogan & Hartson, LLP

(57) ABSTRACT

An apparatus for controlling toner concentration includes a toner concentration detector, a toner supplier, a wave-former that periodically scrapes off toner from a detecting face of the toner concentration detector and thereby forms a wave of decreasing output of the toner concentration detector, and an about-minimum value detector that detects a minimum of the decreasing output. A toner concentration detection retarder is actuated from the time the minimum is detected. The toner supplier is actuated based on the detected toner concentration after the toner concentration detection retarder is released of action. The toner concentration detector includes a waveform measurer that measures the output of the toner concentration detector over a predetermined period longer than the period of one cycle of a scraping cycle, and an about-minimum value judger determines the minimum or its vicinity of the output value measured by the waveform measuring device; and the toner concentration detector is actuated based on the value judged as the minimum or its vicinity by the about-minimum judger before the toner supplier is actuated.

16 Claims, 11 Drawing Sheets

APPARATUS FOR CONTROLLING TONER CONCENTRATION IN AN ELECTROPHOTOGRAPHIC DEVICE

BACKGROUND OF THE INVENTION

1. Field of the Invention

The present invention relates to a developing apparatus using two-component developer in the electrophotographic process of a copying machine, printer, facsimile, etc., specifically, to a toner concentration control device using a toner concentration sensor which detects toner concentration magnetically.

2. Description of the Related Art

Generally, toner concentration detection in an image forming apparatus using a two-component developer is done by detecting the change in permeability of the developer. This is a method of determining the toner concentration by measuring the permeability of the developer for the permeability varies in accordance with the mixing ratio of toner and carrier. In the case of monochromatic developer a magnetic toner and a magnetic carrier are used and in the case of color developer a non-magnetic toner and a magnetic carrier are used.

For example, the output of a permeability sensor is compared with a predetermined reference value, and control is done for keeping the toner concentration constant by supplying toner so that the output of the permeability sensor is equal to the predetermined value.

However, it is difficult to stir the developer composed of toner and carrier, and stagnation of the developer in the proximity of the detecting face of the toner concentration detecting sensor or adhesion of the toner to the detecting face of the toner concentration detecting sensor occurs in a prolonged period of use, inducing erroneous detection of toner concentration. As a result, the control of the toner concentration is not performed properly resulting in varying concentration of toner in the developer to low or high value, and problems such as reduction in print density, scattering of toner, and carrier dragging are induced.

Several methods for evading the problems mentioned above are proposed in Japanese Unexamined Published Patent Application No. 63-106679 (U.S. Pat. No. 4,901,115), No. 1-261683 (U.S. Pat. No. 4,956,669), No. 2-64560 (U.S. Pat. No. 4,974,024), No. 3-256082 (U.S. Pat. No. 5,216,470), and No. 7-306592. In these methods, changes of condition of the developer residing on the detecting face of the sensor are produced by scraping down the developer accumulated on the detecting face positively and cyclically with a scraper to effect cyclic fluctuation of the output of the sensor, bottom of the fluctuation is detected, and toner concentration is determined by measuring the output in the stable range of the output after the bottom of the cyclic fluctuation; or cyclic fluctuation is produced by scraping the toner in the proximity of the detecting face of the sensor, the cyclic fluctuation is superimposed on the output when the scraping is not done to enable the control of the toner concentration over an extended period of time without stagnation of toner in the proximity of the detecting face of the sensor.

However, by these methods of detection of toner concentration, there may occur the case where the proper measurement of toner concentration is not obtained because of the distortion of the output of the toner concentration detecting sensor according as what shape the agitating mixer rib is formed and where the toner concentration detecting sensor is positioned, or the bottom of the cyclic fluctuation of the output of the sensor is not properly determined, resulting in erroneous control of toner concentration.

Further, developer is susceptible to variations of environment, particularly, the output of the toner concentration detecting sensor relatively shifts according to humidity, etc., so it is needed to make it possible to stably determine toner concentration, while excluding the influence of relative variations.

In addition, as the output of a toner concentration detecting sensor varies from one product to another depending on the accuracy of constituent parts and assembling tolerances and pulverulent body such as toner and carrier is susceptible to environment, which exert influences upon the output of the toner concentration detecting sensor, it is needed to make it possible to properly and stably determine the bottom of the fluctuating output of the toner concentration detecting sensor, while excluding these influences.

SUMMARY OF THE INVENTION

The present invention is made in the light of the problems cited above. An object of the invention is to provide a toner concentration control device which can work over an extended period of time, can stably measure the concentration of toner without being influenced by the shape of the stirring mixer of developer and location of the toner concentration detecting sensor, and accordingly can stably control the concentration of toner.

Another object of the invention is to provide a toner concentration device with high reliability which can determine the concentration of toner without being influenced by the variation of environment and variations of the accuracy of constituent parts and assembling.

A further object of the invention is to provide a toner concentration control device in which the face of the permeability sensor can be wiped without reducing the performance of stirring the toner to secure reliable measurement of toner concentration, uniform mixing of toner by stirring can be effected smoothly and in a short period of time, and a good image can be obtained.

To attain the objects cited above, a toner concentration control device according to the present invention is a device having a toner concentration detection means for detecting magnetically the information of concentration of the toner in a developer vessel storing developer composed of a carrier and toner; a toner supply means for supplying the developer based on the output of the toner concentration information; a wave-forming means for forming a wave of decreasing output of the toner concentration detection means reduced through periodically scraping off the toner on the detecting face of the toner concentration detection means with, for example, a mechanical means; and an about-minimum value detection means for detecting the minimum value or its vicinity of the descending output reduced by the wave-forming means; and so configured so that a toner concentration detection retarding means is actuated from the time the minimum value or its vicinity is detected, and the toner supply means is actuated based on the detected toner concentration information after the toner concentration detection retarding means is released of action; wherein the toner concentration detection means comprises a waveform measuring means which measures the output of the toner concentration detection means over a predetermined period longer than the period of one cycle of the scraping cycle, and an about-minimum value judging means which determines the minimum value or its vicinity of the output value measured by the waveform measuring means; and the toner concentration detection means is actuated based on the value judged as the minimum value or its vicinity by the about-minimum judging means before the toner supply means is actuated.

By the configuration cited above, the output of the toner concentration sensor is measured over a period longer than one cycle to determine the minimum value or its vicinity before the control of toner supply is started. Succeeding detection of minimum or its vicinity is performed on the basis of the value determined as above. So, stable and reliable determination of minimum value or its vicinity is possible without being influenced by the shape of the stirring mixer of developer and the distortion of waveform owing to the location of the toner concentration sensor, and without depending on the variation of environment and variations in accuracy of constituent parts and assembling.

Further, the present invention is preferable to be configured so that a detection range determined from the minimum value or its vicinity detected by the about-minimum value detection means in the preceding cycle is provided beforehand, and the about-minimum value detection means determines the minimum value or its vicinity in the cycle concerned from the output of the toner concentration detection means in the said detection range.

By the configuration cited above, as a detection range for detecting the minimum value or its vicinity is determined on the basis of the minimum value or its vicinity of the preceding cycle, stable and reliable determination of minimum value or its vicinity is possible without being influenced by the shape of the stirring mixer of developer and the distortion of wave owing to the location of the toner concentration sensor, and without depending on the variation of environment and variations in accuracy of constituent parts and assembling.

Still further, the present invention is preferable to be configured so that a detection range determined from the minimum value or its vicinity judged by the about-minimum value detection means is provided beforehand, and the about-minimum value detection means determines the minimum value or its vicinity from the output of the toner concentration detection means in the said detection range.

By the configuration cited above, as a detection range for detecting the minimum value or its vicinity is determined on the basis of the minimum value or its vicinity measured and judged as proper through measuring the output of the toner concentration sensor over a period longer than one cycle, stable and reliable determination of minimum value or its vicinity is possible without being influenced by the shape of the stirring mixer of developer and the distortion of wave owing to the location of the toner concentration sensor, and without depending on the variation of the environment and variations in accuracy of constituent parts and assembling.

Yet further, the present invention is preferable to be configured so that the minimum value or its vicinity detected by the about-minimum value detection means and the minimum value or its vicinity detected by the about-minimum value detection means in the preceding cycle are evaluated on the basis of the predetermined value for judgement, and when the result of judgement is out of the judgement criteria, the minimum value or its vicinity detected by the about-minimum value detection means in the preceding cycle is used without replacing it by the value detected by the about-minimum value detection means in the cycle concerned.

By the configuration like this, the minimum value or its vicinity is compared with the minimum value or its vicinity in the preceding cycle, and when the absolute value of difference of the values exceeds the predetermined value for judgement, renewal of the minimum value or its vicinity is not done. By this way, malfunction due to noise is prevented and exceedingly reliable minimum value or its vicinity can be determined when determining next minimum value or its vicinity, and as a result, stable and highly reliable determination of toner concentration is possible.

Yet further, the present invention is preferable to be configured so that the about-minimum value detection means is provided with a detection prohibiting means which prohibits the detection for a proper period, a detection prohibiting period is defined from the point of the minimum value or its vicinity detected by the about-minimum value detection means, and the detection prohibiting means is activated.

By the configuration like this, as the detection of minimum value or its vicinity is not done for a determined period from the time when minimum value or its vicinity has been detected, highly reliable detection of minimum value or its vicinity is possible without influenced by the distortion of waveform caused by the shape of the developer stirring mixer rib, etc. or mounting position of the toner concentration sensor, and without malfunction due to noise, resulting in an extremely stable and highly reliable detection of toner concentration.

Yet further, the present invention is preferable to be configured so that the minimum value detection means is provided with a period judging means for detecting and judging the period of the waveform of toner concentration for a proper period, the about-minimum value detection means is activated on the basis of the value judged as minimum value or its vicinity by the about-minimum value judging means, and the toner supply means is actuated when the period of the waveform of toner concentration is judged proper by the period judging means.

By the configuration like this, as whether the minimum value or its vicinity judged by the about-minimum vale judging means is proper or not is evaluated by investigating the period before the control of toner supply is started, highly reliable detection of minimum value or its vicinity and versatile control of toner concentration containing retry process, etc. are possible.

Yet further, the present invention is preferable to be configured so that the minimum value detection means is provided with a variation judging means which detects and judges the defined variation of the output of the toner concentration detection means, and the actuation of the toner supply means is prohibited when the defined variation of the output of the toner concentration is abnormal.

By the configuration like this, abnormal detection of toner concentration caused by the damage of the sensor or absence of the developing unit is evaluated properly and the control of toner concentration with high reliability is possible.

Means cited hereinbelow specify the means for generating a waveform by periodically scraping off the developer composed of a plurality components. The waveform generating means is a mechanical mixing means so composed so that the developer composed of a plurality of components is mixed by stirring with spiral projections provided on the periphery of a rotating hollow cylindrical body. The mechanical mixing means has spiral projections differing in phase by a constant angle to each other, the height of a part of each projections, the axial position of the parts corresponding to the position of the toner concentration detection means, is different from that of the remaining part of the spiral projections to allow the one part to work as a scraper for scraping off the developer on the detecting face of the toner concentration detection means and another part to work for compressing the developer on the detecting face of the toner concentration detection means, and the toner concentration detection means detects the toner concentration when the developer is compressed to control toner concentration.

By so composing, not providing a scraper composed of sponge, etc., so that the scraping is carried out by making a part of a projection provided on the periphery of the hollow cylindrical body different in height from the remaining part of the spiral projection, and the compression of the developer on the detecting face of the toner concentration detection means is carried out by a part of another projection provided with a phase difference of a constant angle, the part which impairs the axial flow of the developer is eliminated, so scraping of the detecting face of the toner concentration detection means, reliable measurement of toner concentration, and smooth and uniform mixing by stirring in a short period of time are possible, and a toner concentration control device capable of obtaining a superior image can be provided.

It is suitable to form the projections continuing on the periphery of the hollow cylindrical body including the part functioning as scraper or preferably the part functioning as scraper is attached exchangeable on the hollow cylindrical body, and further, the gap between the tip of the scraping part of the spiral projection and detecting face of the toner concentration detection means is 1 mm or smaller, preferably 0.5 mm or smaller.

By this configuration, as the spiral projections are provided continuing on all over the hollow cylindrical body, the axial flow of developer is not impaired and stirring performance is not reduced, and with exchangeable spiral projection for scraping, it can be easily exchanged in the case of its wear or damage due to any cause. More reliable scraping is possible by setting the gap between the tip of the scraping part of the spiral projection and detecting face of the toner concentration detection means is 1 mm or smaller, preferably 0.5 mm or smaller.

That the detection of toner concentration in the toner concentration control device composed like this is preferable to be provided with a toner concentration detection retarding means which retards the detection time of the toner concentration of the developer when it is compressed from the time when the output of the toner concentration detection means is minimum due to scraping off of the developer on the detecting face of the toner concentration detection means with the scraping part of the spiral projection, is as has been described in the foregoing.

By the configuration as has been described, the control of toner concentration capable of obtaining superior image is possible owing to being able to keep the timing of toner concentration detection always constant and to being able to perform reliable measurement of toner concentration.

BRIEF DESCRIPTION OF THE DRAWINGS

FIG. 3(*b*) is an external view of the primary mixer of FIG. 3(*a*) rotated by an angle of 180 degrees around the center axis FIGS. 4(*a*), 4(*b*), (4*c*), 4(*d*) and 4(*e*) are external views showing another type primary mixer (commonly known as a stirring mixer) mounted in a developer vessel according to the present invention. FIG. 4(*d*) is a sectional view along line A-A shown in FIG. 4(*b*). FIG. 4(*e*) is a sectional view along line B—B shown in FIG. 4(*c*).

DETAILED DESCRIPTION OF THE PREFERRED EMBODIMENTS

A preferred embodiment of the present invention will now be detailed with reference to the accompanying drawings.

Figure 1:
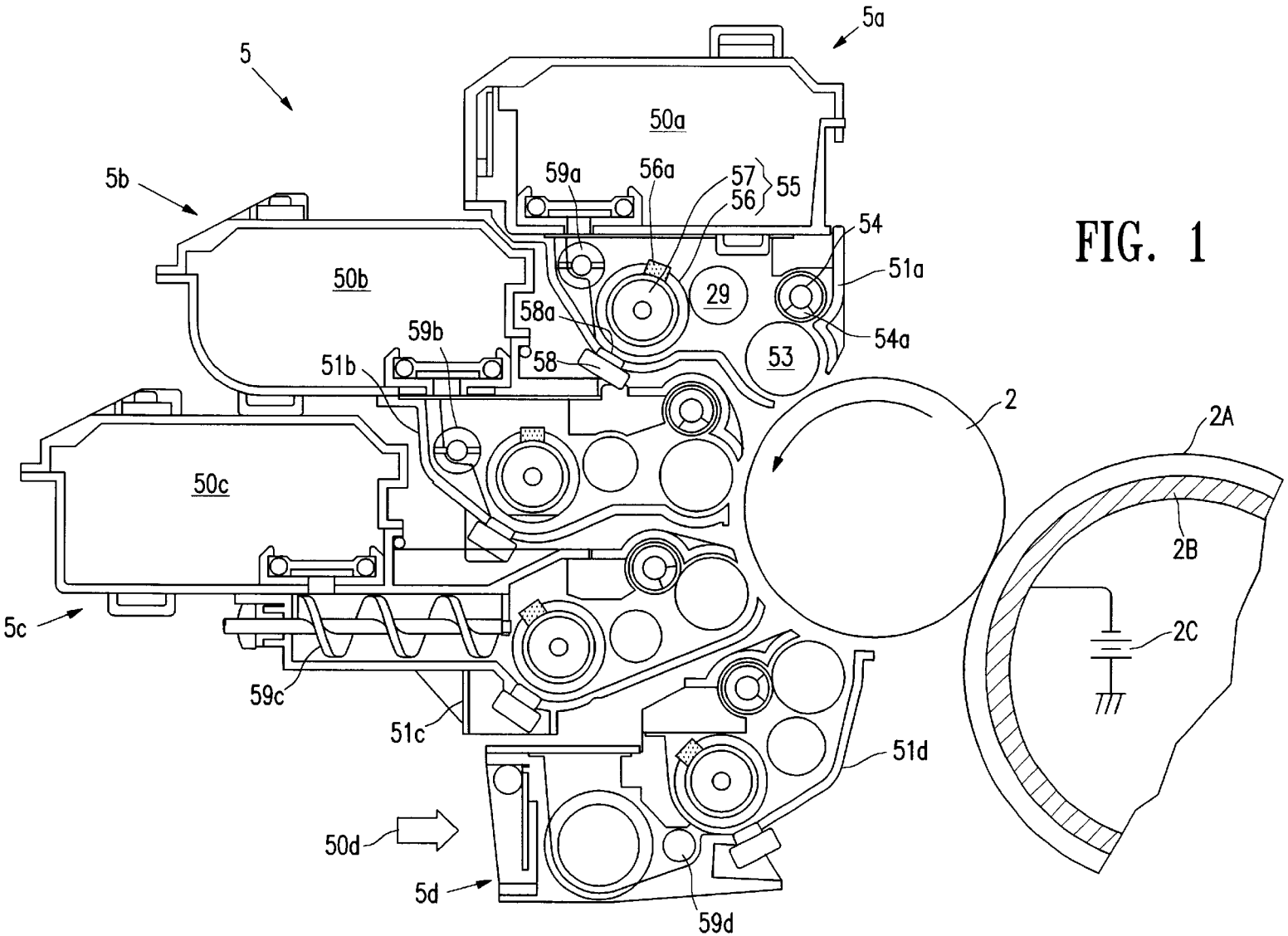
FIG. 1 is a partial sectional view showing the internal construction of a color developing device mounting an embodiment of a toner concentration control device according to the present invention.
Figure 2:
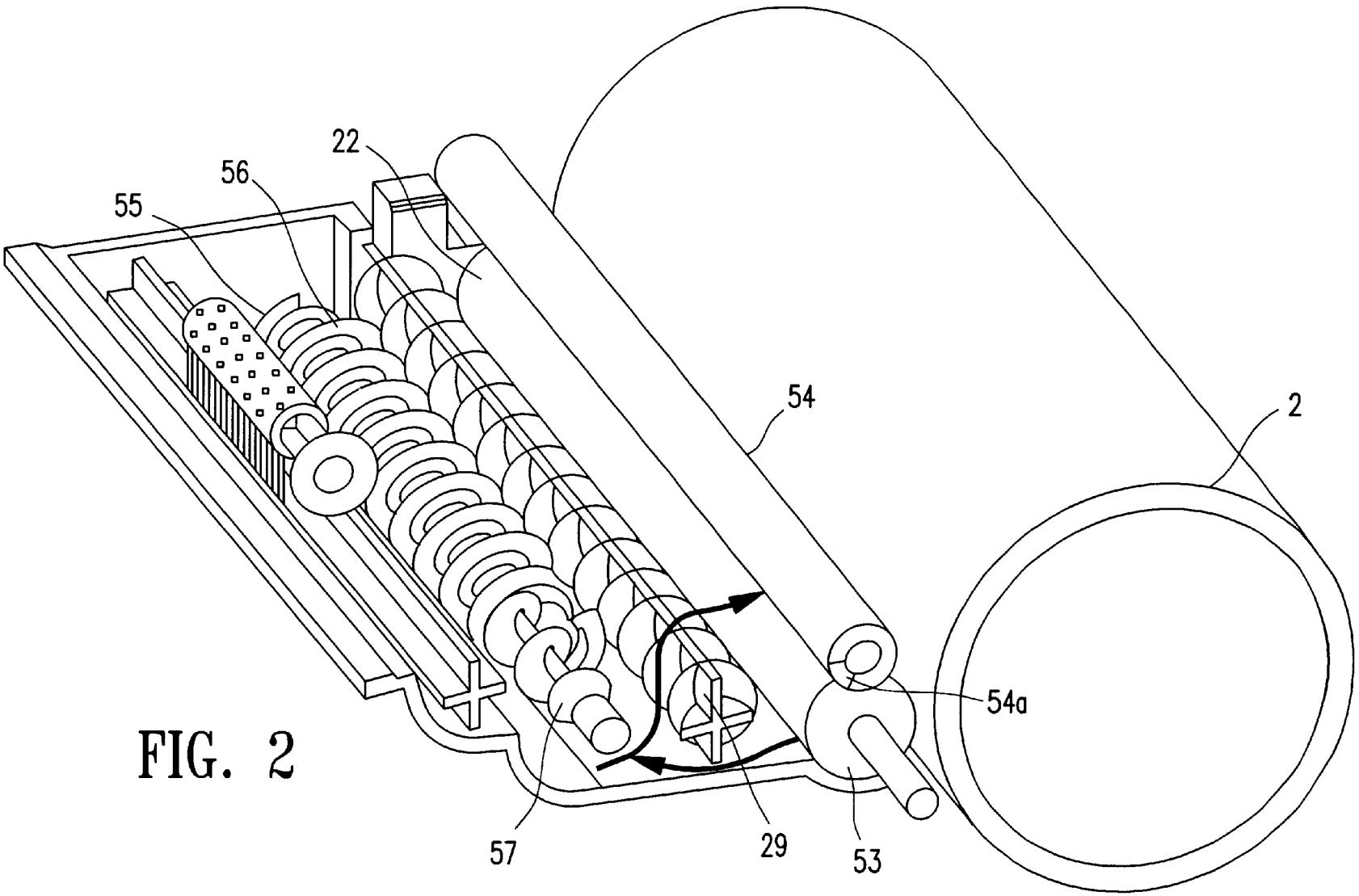
FIG. 2 is a perspective view showing the internal construction of a developing device of an embodiment according to the present invention.

FIG. 1 is a schematic overview showing a photoreceptor drum and developing devices in a color image forming apparatus provided with a toner concentration control device according to the present invention. FIG. 2 is a perspective view showing the inside composition of the developing device. A diagrammatic representation of the composition of the color image forming apparatus is shown in Unexamined Published Patent Application No. 2000-112220, and a toner concentration control device having a toner concentration detection means for detecting magnetically the information of concentration of the toner in a developer vessel storing developer composed of a carrier and toner; a toner supply means for supplying the developer based on the output of the toner concentration information; a wave-forming means for forming a wave of reduced output of the toner concentration detection means reduced through periodically scraping off the toner on the detecting face of the toner concentration detection means; an about-minimum value detection means for determining the minimum value or its vicinity of the descending output reduced by the wave-forming means; and composed so that a toner concentration detection retarding means is actuated from the time the minimum value or its vicinity is detected, and the toner control means is actuated based on the detected toner concentration information after the toner concentration detection retarding means is released of action, is shown in Unexamined Published Patent Application No. 2000-112221. Therefore, the disclosed part of the configuration will be explained briefly.

In FIG. 1 and FIG. 2, reference numeral 2 is a photoreceptor drum made of OPC or a-Si and rotates in a counterclockwise direction. Numeral 5 are four developing devices for developing color toner on the latent image formed on the photoreceptor drum 2. The developing devices 5 are arranged from upstream of the rotation direction of the photoreceptor drum in the order of a developing device 5*a* for developing yellow, a developing device 5*b* for developing magenta, a developing device 5*c* for developing cyan, and a developing device 5*d* for developing black.

The developing devices 5*a*~5*d* are composed of a toner vessel 50*a* storing yellow toner and a developer vessel 51*a* for developing the supplied toner, a toner vessel 50*b* storing magenta toner and a developer vessel 51*b* for developing the supplied toner, a toner vessel 50*c* storing cyan toner and a developer vessel 51*c* for developing the supplied toner, and a toner vessel 50*d* (not shown) storing black toner and a developer vessel 51*d* for developing the supplied toner, respectively. Although non-magnetic toner of each color are used in the present invention, magnetic toner is also able to be used.

In the embodiment, an intermediate transfer drum 2A is disposed to contact the photoreceptor drum 2 at the opposite side of the developing devices 5*d* across the photoreceptor drum 2 downstream of the rotation direction of the photoreceptor drum 2, the intermediate transfer drum 2A being able to be rotated with the same peripheral speed as the photoreceptor drum. The transfer drum 2A is composed of a metal drum 2B as its base. Overlaying of colors is done by sequentially transferring(primary transfer) each color toner developed on the photoreceptor drum 2 through applying a predetermined bias 2C to the metal drum 2B. Then, the overlaid image is transferred to a sheet which is aligned of the tip and adjusted of timing by a pair of register rollers and transferred between the intermediate transfer drum 2A and a secondary transfer roller (not shown) to be transferred to a fixing device for fixing the image. The sheet is then let out.

Figure 8:
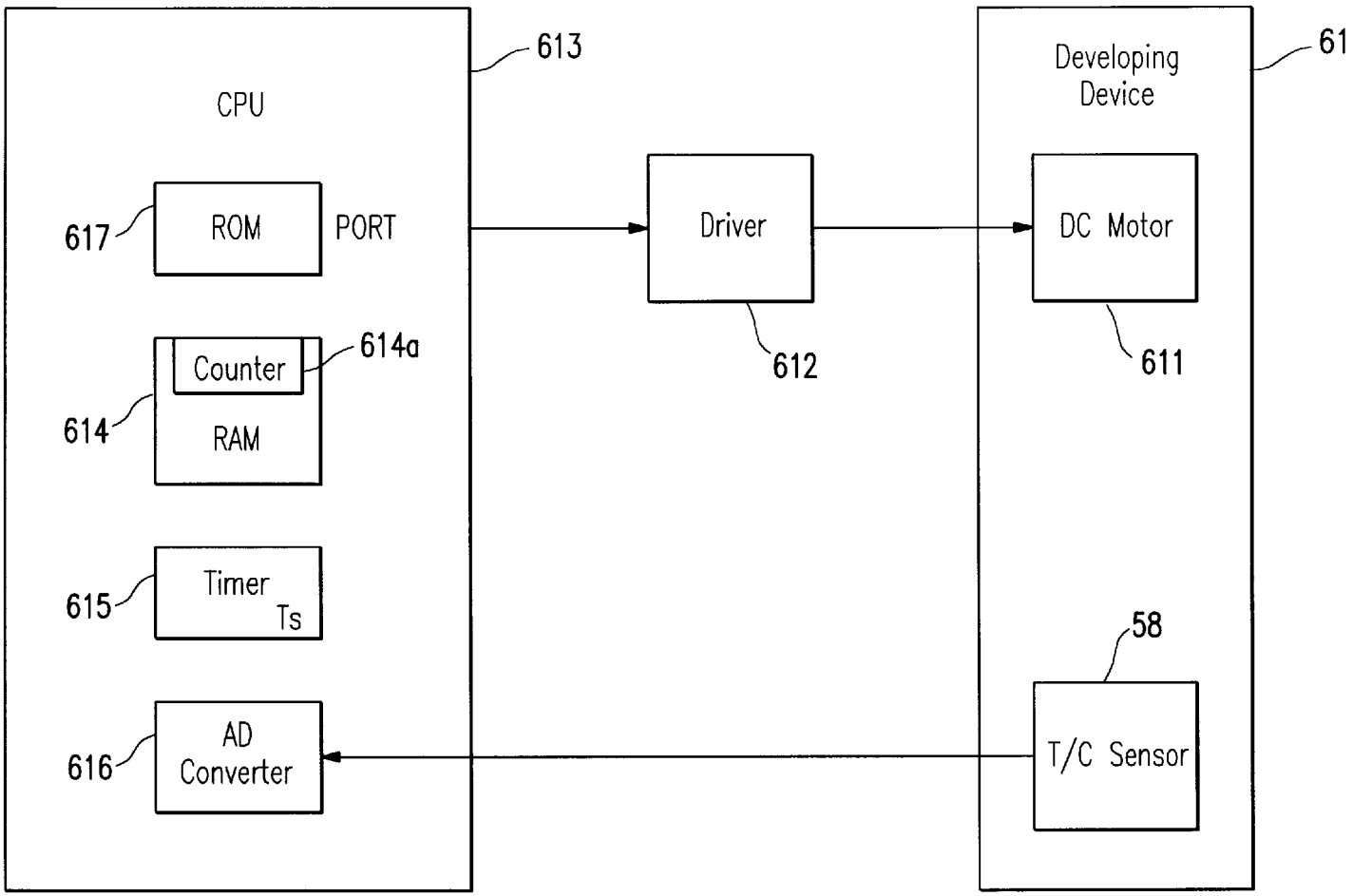
FIG. 8 is a control block diagram of an embodiment according to the present invention.

Reference numeral 59*a*~59*d* are toner supply means for supplying toner from toner vessels 50*a*~50*d* to the developer vessels 51*a*~51*d*. The toner supply means may be composed as a feeder type supply means 59*c* or a supplying roller 59*d* made of sponge depending on the distance between the toner vessel and developer vessel. Any way, the toner supply means 59*a*~59*d* are driven, as shown in FIG. 8, intermittently by controlling a DC motor 611 by the medium of a CPU 613 and a driver 612.

By driving the toner supply means 59*a*~59*d*, toner of each color is supplied to each developer vessel 51*a*~51*d* in which magnetic carrier is mixed with toner of each color. For the sake of simplicity, explanation will be done about the working of the developer vessel 5*a* of yellow toner, about the other developer vessels denotation of constituent components and explanation are omitted as their function is the same.

Reference numeral 53 is a developing roller inside which is disposed a magnet (not shown). The developing roller 53 can be rotated with the developer, which is a mixture of toner and carrier mixed in the developer vessel 51*a*, held on the perimeter by the magnetic force of the said magnet. Reference numeral 54 is a developer regulating element which has a fan-shaped magnet 54*a* on one side inside it to form a magnetic shield on the surface of the developing roller 53 for transferring the developer only when developing is performed to the developing position on the developing roller 53 facing the photoreceptor drum.

Reference numeral 55 is a primary mixer, a mechanical stirring means, composed of an outer mixer 56 and an inner mixer 57 of screw type to obtain increased stirring vessel according to the present invention. performance. The outer mixer 56 is provided with a scraper 56*a* which is a feature of the present invention.

Next, the composition of the primary mixer 55 will be explained with reference to FIG. 3 and FIG. 4.

FIG. 4 illustrates details of the shape of the primary mixer 55. To explain briefly, the hollow cylindrical outer mixer 56' having on its periphery a spiral projection 61, another spiral projection 64 spiraling with a constant phase difference to the spiral projection 61, an opening 62, and a scraper 63 is shown in FIG. 4(*a*), (*b*), (*c*) in the states rotated by an angle of 120 degree respectively. A sectional view along line 4*d*—4*d* in FIG. 4(*b*) is shown in FIG. 4(*d*), and a sectional view along line 4*e*—4*e* in FIG. 4(*c*) is shown in FIG. 4(*e*). The scraper 63 is a sponge or rubber or urethane foam covered with artificial leather, etc.

Inside the hollow cylindrical outer mixer 56' is provided a screw type inner mixer 57 (spiral transfer element) as cited above but not shown in FIG. 4, and the screw type inner mixer 57 transfers the developer in the direction reverse to that the developer is transferred by the spiral projections 61 and 64 of the outer mixer 56'. A permeability sensor 58 is provided facing the hollow cylindrical outer mixer 56' at the bottom side of the developer vessel 51*a* where the scraper 63 can wipe the detecting face 58*a* at every rotation of the hollow cylindrical outer mixer 56'.

When the hollow cylindrical outer mixer 56' is rotated in a clockwise direction while its periphery is filled with the developer composed of toner and carrier supplied by the toner supply means, the developer is transferred with the spiral projections 61 and 64 to the left in FIG. 4 and falls inside the hollow cylindrical outer mixer 56' from the openings 62 when they are facing upward. The developer fallen in the hollow of the hollow cylindrical outer mixer 56' is transferred to the left by the spiral transfer element not shown, and flows out to the outside of the hollow cylindrical outer mixer 56' from the openings 62 when they are facing downward. Therefore, the developer circulates in the interval of pitch of the openings 62 while being agitated.

The output of the permeability sensor 58 shown in FIG. 1 is at minimum when the scraper 63 has wiped the detecting face of the sensor 58 to scrape off the developer through the rotation of the hollow cylindrical outer mixer 56', then increases as the developer fallen down from the opening 62 at the center part accumulates on the detecting face of the sensor 58. So, the output of the permeability sensor 58 repeats pulsation with a periodic time of one rotation of the hollow Cylindrical outer mixer 56'. The control of toner concentration with high reliability is made possible by measuring permeability, that is, by determining toner concentration at the time the developer accumulates on the detecting surface of the sensor 58, and on the other hand, by sending out an error signal when the pulsation does not occur, as this is when the stirring device or the permeability sensor is in trouble.

However, the primary mixer 55 shown in FIG. 4 has a scraper 63 provided at the center of the stirring device as shown in FIG. 4(*a*) and (*b*), and at the position where the scraper 63 is provided, there is provided the opening 62 and the spiral projection 61 is cut, so the axial flow of the developer is interrupted and stirring performance is decreased.

Figure 3A:
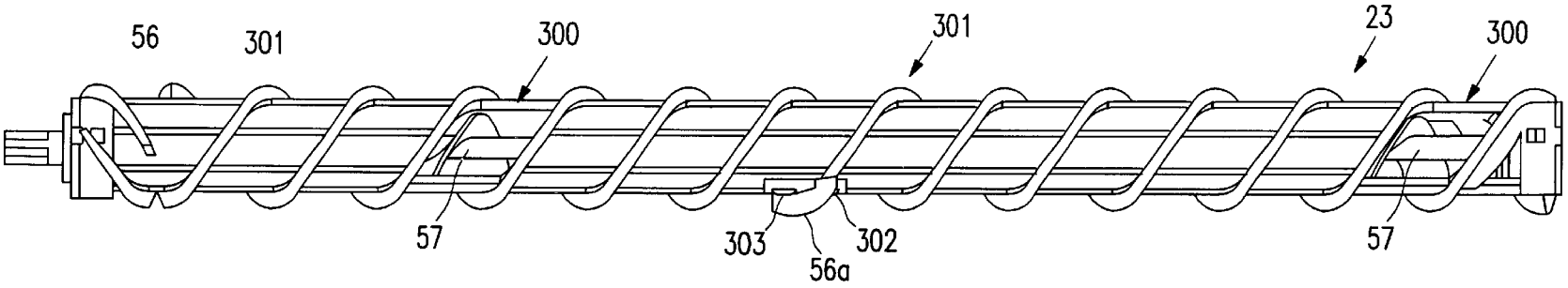
FIG. 3(*a*) is an external view showing an embodiment of a new type primary mixer according to the present invention mounted in a developer vessel.
Figure 3B:
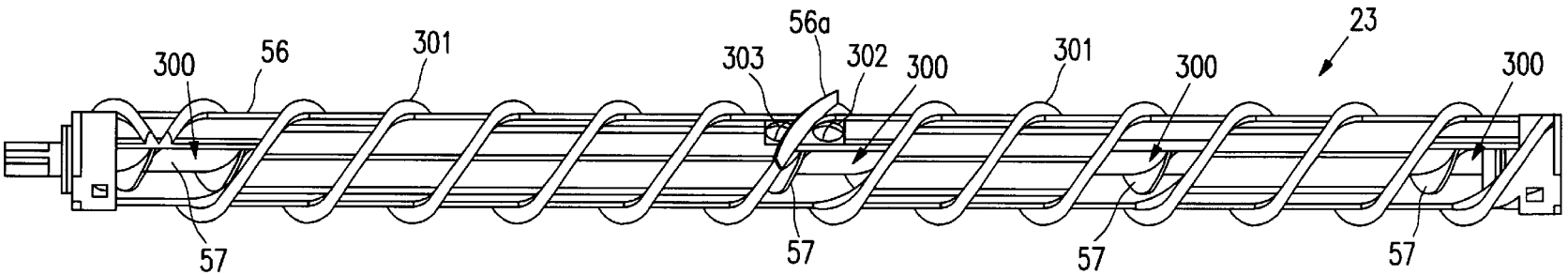
Figure 4A:
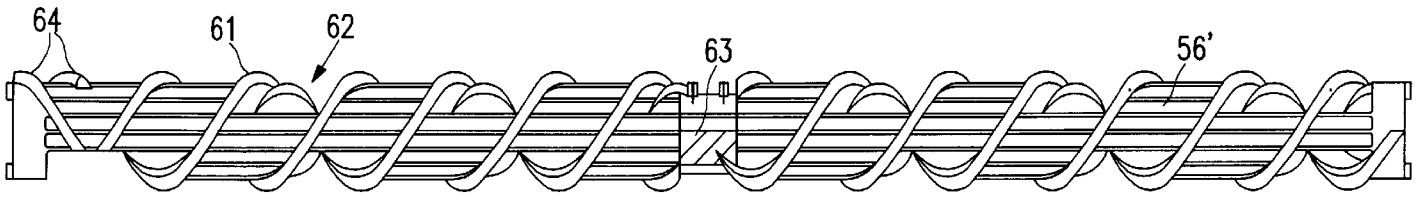
FIGS. 4(*a*), 4(*b*) and 4(*c*) are external views in states rotated by an angle of 120 degrees around the center axis.
Figure 4B:
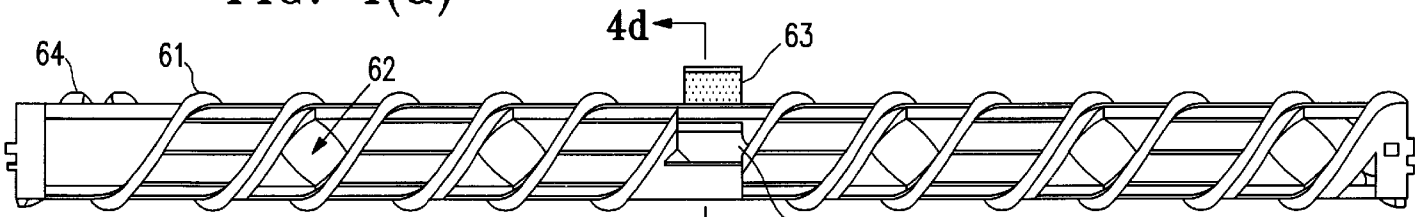
Figure 4C:
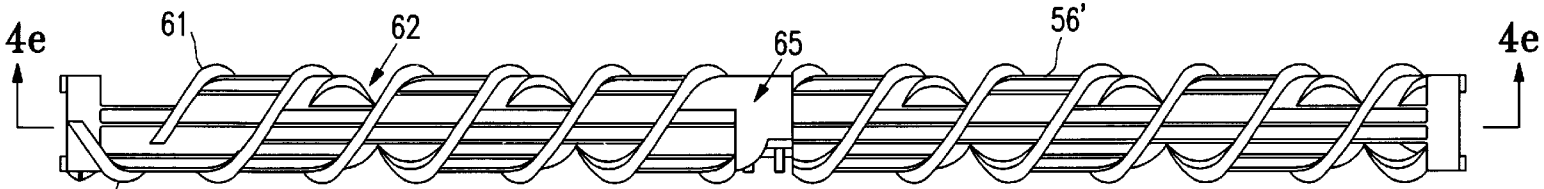
Figure 4E:
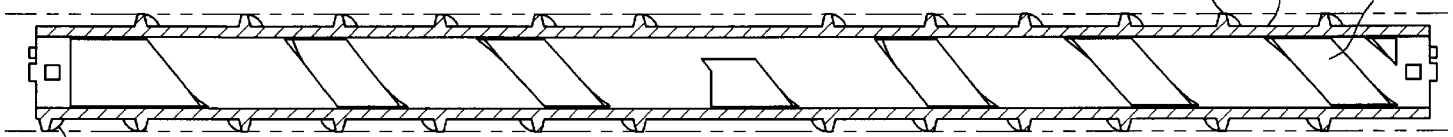
Figure 4D:
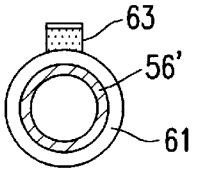

To solve this problem, the inventor proposes a primary mixer shown in FIG. 3 which can wipe out the face of the permeability sensor 58 without reducing stirring performance and as a result makes possible the proper measurement of toner concentration together with uniform mixing by stirring in a short period of time.

In FIG. 3, reference numeral 56 is an outer mixer composed of a hollow cylindrical body. FIG. 3(*b*) is a view when the outer mixer 56 of FIG. 3(*a*) is rotated by an angle of 180 degree. On the periphery of the outer mixer 56 are provided a continuing opening 300 on the periphery, spiral projections 301, and a scraper 56*a* of the same spiral shape as the spiral projections 301, the height of the scraper 56*a* from the periphery of the outer mixer 56 being larger than that of the spiral projections 301 and the scraper 56*a* being fixed to the cylindrical body by screws 302 and 303 to be exchangeable. The spiral projections 301 have no cut part like the cut part 65 of the spiral projection 61 shown in FIG. 4(*c*), and continue all along the outer mixer 56.

The developer on the periphery of the outer mixer is transferred along the spiral projections 301 by the rotation of the outer mixer 56, falls inside the outer mixer 56 from the opening 300 provided on the periphery of the hollow cylindrical body, and transferred in an axial direction by a spiral transfer element 57 provided in the hollow of the outer mixer 56 to be let out from the opening 300 when it faces downward to be stirred.

The scraper 56*a* rotates with its tip keeping a distance of 1 mm or smaller, preferably 0.5 mm or smaller from the detecting face 58*a* to scrape out the toner on the sensor 58. The spiral projections 301 rotate with their tips keeping a distance of between or equal to 1.8 mm and 5 mm, preferably about 1.8 mm from the detecting face 58. The scraper 56*a* has been explained to be screwed to the outer mixer 56, it is suitable to form it to be a part of one of the spiral projections 301.

Here, returning to FIG. 1, reference numeral 58 is a toner concentration sensor (detection means) and a permeability sensor is used as sensor. The toner concentration sensor 58 detects magnetically the change of the toner concentration (in volume) of the developer transferred while being stirred to the detecting face 58 and accumulated thereon.

The developer accumulated on the detecting face 58 is periodically scraped away by the scraper 58*a*. Reference numeral 29 is a secondary mixer which transfer the developer toward the developing roller 53 while stirring the developer. The secondary mixer 29 may be composed of a magnetic roller or a screw vane.

By composing as cited above, it is possible to stir the developer according as the scraper 56*a* rotates with the rotation of the primary mixer 55. So the toner concentration detected oscillates periodically with the rotation of the primary mixer 55.

Figure 5:
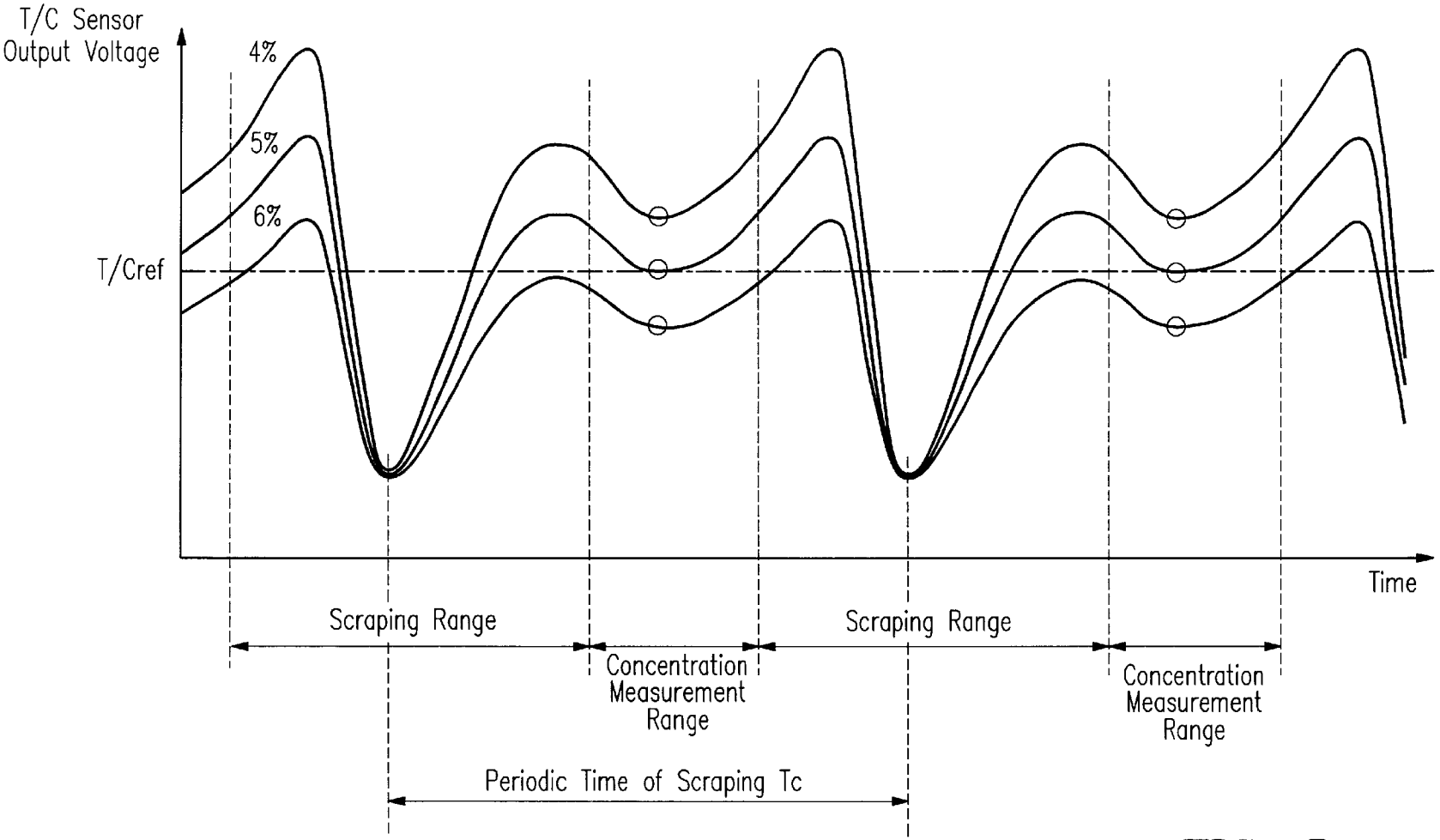
FIG. 5 is a graph showing outputs obtained from a toner concentration sensor in relation to time.

In FIG. 5 is shown an output of the toner concentration sensor 58 obtained by the composition cited above. In FIG. 5, output voltages in each case the toner concentration is 4%, 5%, and 6% are shown. In the figure, periodic time of scraping Tc is the period the scraper 56*a* scrapes out the developer on the detecting face 58*a* of the toner concentration sensor 58 and represent one rotation of the outer mixer 56. Scraping range is a time period during which the scraper 56*a* is scraping off the developer on the detecting face of the toner concentration detecting sensor 58, concentration measurement range is a time period during which the developer covers the detecting face 58*a* of the toner concentration detecting sensor 58 after the finish of the scraping with the scraper 56*a* and so the effective measurement of toner concentration is possible, and T/Cref is a reference toner concentration. As can be recognized from FIG. 5, the output varies according to the mixing ratio of toner and carrier. The output voltage of the toner concentration detecting sensor 58 decreases as the mixing ratio of toner and carrier (toner concentration) increases. Therefore, the DC motor 611 for driving the toner supply element 59 is controlled by the CPU 613 and driver 612 (see FIG. 8) so that toner is supplied from the toner vessel 50*a*~50*d* so as to keep always the mixing ratio of toner and carrier to the reference value of T/Cref.

The occurrence of cyclic voltage reduction in scraping range is due to the scraping of the developer accumulating on the detecting face 58*a* of the toner concentration detecting sensor 58 with the scraper 56*a*. The oscillating component generated due to the scraping of the developer on the detecting face 58*a* of the toner concentration sensor 58 according to the rotation the scraper 56*a* is overlaid on the output of the toner concentration 58 of the time range when the toner accumulation on the detecting face 58*a* is normal. Accordingly, the output in the scraping range is the one intentionally reduced, and there is a high possibility that the toner concentration in this range is unstable.

Therefore, according to the present invention, the detection of toner concentration is not carried out in the scraping range (detection time is retarded by a toner concentration detection retarding means), it is carried out in the concentration measurement range succeeding the scraping range, where the output obtained from the concentration of developer is stable, to detect T/C data Xi.

The concentration measurement range is established in the time range when the scraper 56*a* attached to the outer mixer 56 is rotated to the position just opposite to the detecting face 58*a* of the toner detecting sensor 58. In this concentration measurement range, there is not the large reduction of output voltage generated intentionally by scraping the detecting face 58*a* of the concentration sensor 58 with the scraper 56*a*, and there the developer on the detecting face 58*a* of the concentration sensor 58 is a little compressed due to the sweeping with one of the spiral projections 301.

Reduction of output of the toner concentration sensor 58 in this range is resulted from the compression of the toner accumulated for a time on the detecting face 58*a*. Relative change in toner concentration does not occur by this compression, rather more stable detection of toner concentration is carried out, for the carrier and toner of the developer is compressed.

Although, in FIG. 5, the detection is done once in a concentration measurement range, it is not limited to once, and detection of plural times in a concentration range is suitable.

A retarding time during which the detection of toner concentration is not done is started from the time when the output of the toner concentration sensor 58 has decreased. The time of retarding start is not particularly limited, any time when the output of the toner concentration sensor 58 has decreased in the scraping range is suitable, however, it is the most preferable to take the time when the output of the toner concentration sensor 58 is at minimum, or at bottom as a reference time for the start of retarding.

However, the output of toner concentration largely changes depending on the shape of the stirring mixer rib, environment, accuracy of constituent parts and assembling, etc., and so the bottom of the output in the scraping range changes. Therefore, in the embodiment, the output of the toner concentration sensor 58 is monitored before performing control of the toner concentration to determine the bottom, and the timing of measurement of toner concentration is produced taking the time of the determined bottom as the reference time.

Figure 6:
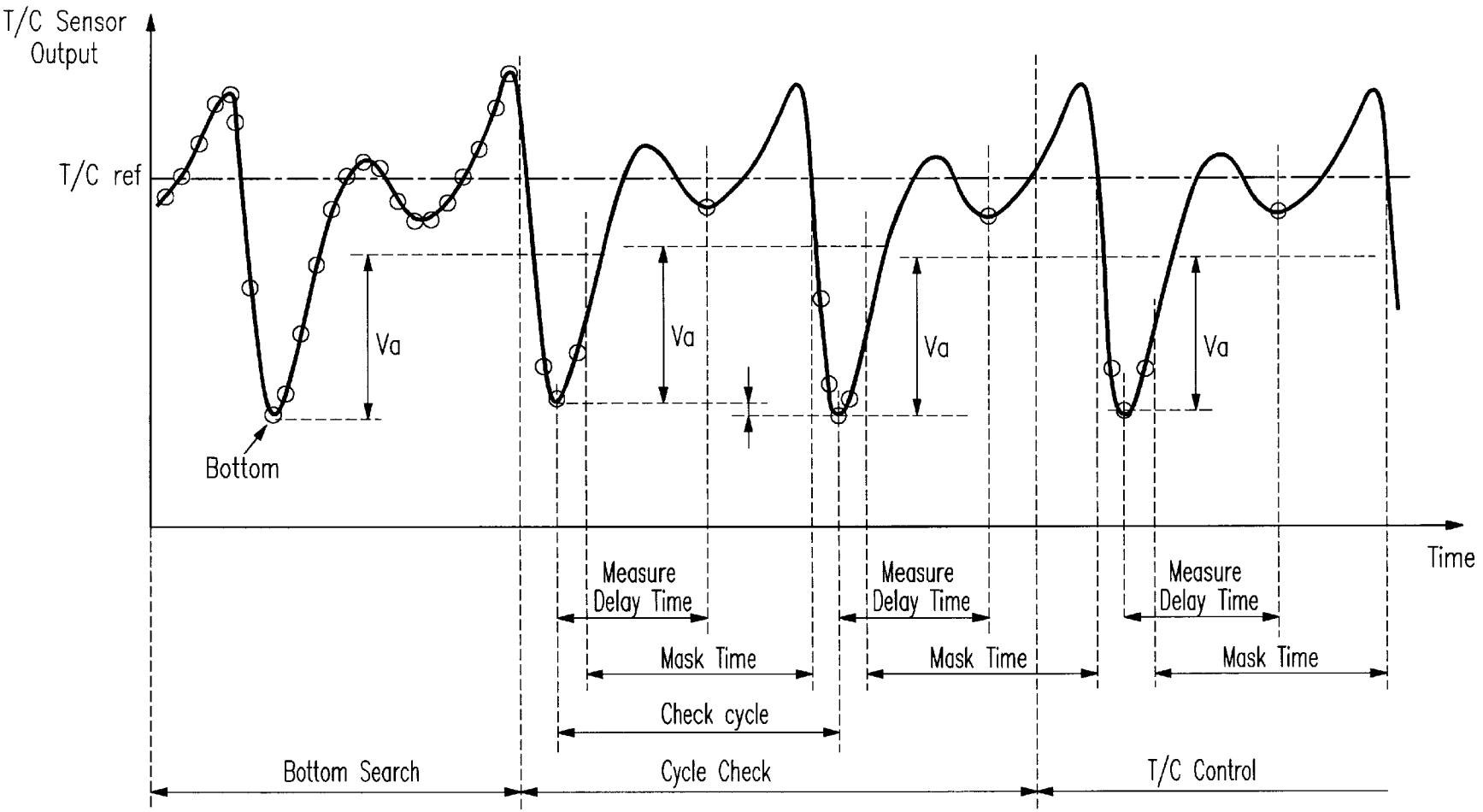
FIG. 6 is a graph showing the timing of the start of measurement by the toner concentration sensor.

Next, the starting procedure of the control of toner concentration will be explained with reference to FIG. 6. The control of concentration of toner is carried out after two steps, i.e., a bottom search and a periodic time check, as shown in FIG. 6.

At first, as a first step, bottom search is done, in which the lowest output during the scraping off of the toner on the detecting face 58*a* of the toner concentration detecting sensor 58 with the scraper 56*a* is detected by sampling the output of the toner concentration detecting sensor 58 at an interval of sampling period Ts smaller than or equal to one tenth, or smaller than or equal to one twentieth of the periodic time of scraping Tc shown in FIG. 5 before the control of toner concentration is started.

As a second step, a check on the periodic time is done, in which timing for detecting the bottom and toner concentration of succeeding cycle is produced in relation to the time of the bottom detected in the first step and the detection is carried out with the timing. In this step, sampling is done beyond a cycle of the output of the toner concentration to check the periodic time of bottom in order to judge the effectiveness of the detection of the bottom in the first step. When the periodic time is judged to be proper in this step, the control of toner concentration is put carried out. If the period time is judged to be improper, the control of toner concentration is not put into effect but error handling is carried out. The error handling includes retry.

A more detailed explanation of the second step is as follows: timing is produced in relation to the time of the bottom obtained in the first step, sampling over the range beyond the scraping period (periodic time of scraping) Tc is done to detect another bottom for detecting the period time for the evaluation of the effectiveness of the detection of bottom, and the concentration of toner is measured after the timing retard Td from the bottom. That is, a bottom is detected in the first step, after the detection of the bottom a counter 614*a* in aRAM 614 shown in FIG. 8 is cleared, judgement is done whether it is a periodic time from the bottom or not, if not, the counting is renewed at every interrupt with a constant time(the interrupt period is the sampling period Ts) by the CPU timer 615, judgement is done whether the counter time Td, the timing retard, or not, and when it is the timing retard Td the toner concentration is measured.

The timing retard Td is set in a retarding means in the timer circuit 615, etc. to carry out the measurement of the toner concentration with the timing retard Td. When the periodic time is judged not to be proper, error handling is done.

When the period time of bottom is proper, a mask time is set, during which the bottom detection is not performed in order not to mistake the reduction of the output due to the compression by one of the spiral projections 301 in the concentration measurement range for bottom. Further, a voltage higher by Va than the bottom voltage detected in the preceding detection (the bottom voltage+Va ) is defined,f bottom detection is done only in the output range below this voltage (the bottom voltage+Va), and the bottom voltage is judged as proper only when the absolute of the difference between the voltage of the preceding detection and that of the detection of this time is Vb or smaller. In this way, accommodation to the change of the reference toner concentration T/Cref is possible and the bottom is properly determined in spite of varying bottom voltage due to noise.

When an electrophotographic apparatus provided with a developing device of the present invention is switched on, the outer mixer 56 and inner mixer 57 of the primary mixer 55 rotate, and the developer on the outer mixer 56 is transferred along the spiral projections 301 to be fallen into the inside of the outer mixer 56 from the openings 300 provided as appropriate. Then the developer is transferred by the inner mixer 57 provided inside the outer mixer 56 to the direction opposite to that the developer is transferred by the outer mixer 56 to be fallen off this time to the outside of the outer mixer 56 from the openings 300 facing downward by the rotation of the outer mixer 56, and there the developer is agitated.

Then, there occur the scraping off of the developer from the detecting face 58*a* of the toner concentration detecting sensor 58 through the rotation of the outer mixer 56, the subsequent accumulation of developer on the detecting face 58*a*, and the compression of the developer with the spiral projection 301. Then the sampling of the output is carried out at the interval of sampling period Ts (interruption period). Then a bottom is detected in the range defined as bottom search in FIG. 6, after the detection of the bottom the counter 614*a* in the RAM shown in FIG. 8 is cleared, the counting of the counter 614*a* is renewed at every interruption with a constant time by the CPU timer 615, mask time (masking period) is set, and whether bottom or not is judged.

Subsequently, a bottom is again detected in the range defined as cycle check by sampling over a time period exceeding the periodic time of scraping Tc, after the detection of the bottom the counter 614*a* is cleared, the counter 614*a* is renewed at every interruption with a constant time by the CPU timer 615, whether the timing retard Td or not is judged while the detection of the period of bottom is done, the effectiveness of the detection of the bottom is judged, and the measurement of the toner concentration is effectuated when the counter time is Td, the timing retard.

That is, when the cycle time of bottom is judged to be proper, a detection of toner concentration is done in the succeeding range defined as toner concentration control after the timing retard Td from the bottom. A mask time for prohibiting the detection of bottom lest the decrease of the output due to the compression by the spiral projection 301 in the concentration measurement range is mistaken for the bottom, and the detection of bottom in the mask time is not done. Further, a voltage higher by Va than the bottom voltage detected in the preceding detection is defined, bottom detection is done only in the output range below this voltage (the bottom voltage+Va), and the bottom voltage is judged as proper only when the absolute of the difference between the voltage of the preceding detection and that of the detection of this time is Vb or smaller. When the periodic time is judged not proper, error handling is carried out.

The timer 615 shown in FIG. 8 clears the counter 614*a* in the RAM 614 shown in FIG. 8 when the bottom is determined, the counter 614*a* renews counting to actuate the timer 615 until the timing retard Td is reached while the detection of bottom effected due to the scraping off of the developer on the detecting face 58*a* of the toner concentration detecting sensor 58 the toner concentration being done, the toner concentration is detected after the timing retard Td from the bottom, and when the toner concentration is low the toner supply element 59 is driven by the DC motor 611 to supply the toner from the toner vessel 50 to the primary mixer 55 of the developer vessel 51.

Figure 7:
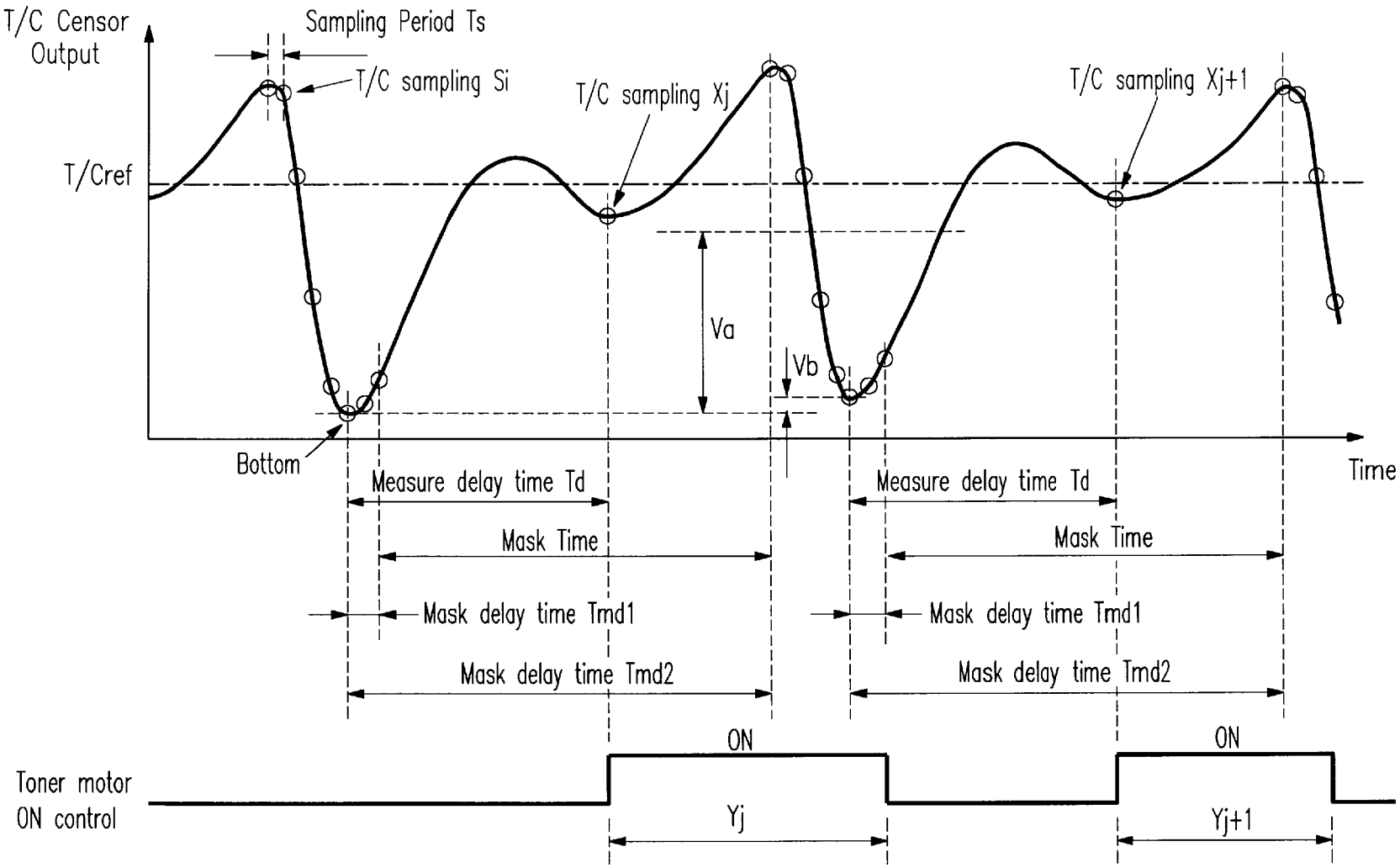
FIG. 7 is a graph showing the measurement timing of the toner concentration sensor.

Next, the toner concentration detection timing according to the present invention is shown in FIG. 7. The detection of toner concentration is done at the time retarded by Td from the bottom which is detected by sampling the output of the toner concentration sensor, in which the time for entering the predetermined concentration measurement range is measured by the timer 615 and the detection timing of the toner concentration is retarded by Td from the bottom. In this case, by defining the bottom detection range(bottom search) and detecting the bottom in the output range below the voltage higher by Va than the voltage of the bottom detected by the preceding bottom detection, stable detection of bottom is possible without influenced by noise. With the bottom detection like this, the method of detection of bottom is not largely influenced even in the case of a substantial modification in design resulting in the change the reference value T/Cref of toner concentration.

The bottom detection essentially not varies every time the measurement isdone. But for evading misjudge owing to noise, the device according to the present invention is configured so that the data of bottom is renewed only when the change between the preceding data and the newly detected data is smaller than the predetermined value Vb. By the configuration like this, accommodation to the variation of the environment, etc. is possible and the influence of noise can be reduced.

Also, by configuring so that mask time during which bottom detection is not done is provided between a predetermined first timing retard Tmd1 and a predetermined second timing retard Tmd2, mistaking the output reduction of the toner concentration sensor due to the compression by the stirring mixer rib, etc. for the bottom is prevented. Thus, by providing the bottom search and mask time, very stable and highly reliable detection of bottom is possible.

It is desirable to set the sampling period Ts to equal to or shorter than one tenth, preferably equal to or shorter than one twentieth of the scraping period Tc, though it depends on the detected output waveform in the scraping range, for the reliable detection of bottom can not be attained if the sampling period Ts is not short enough compared to the scraping period Tc. As the variation in the output curve due to the scraping is a periodic variation, the judging whether the developing device is mounted or not, and checking malfunction of the toner concentration sensor are possible.

Next, a control block diagram provided in a color image forming apparatus for performing the control of toner concentration is shown in FIG. 8. A control unit is composed of a ROM 617 holding a control program, a RAM 614 for temporally storing parameters and data with a counter 614*a* which sets the sampling period Ts as a interrupt period integrated in it, a timer 615 for setting the timing retard Td while renewing the counter 614*a*, a CPU 613 with an AD converter 616 for converting the analog signal of the toner concentration sensor 58 to a digital signal integrated in it, a developing device 610 with a DC motor 611 for driving the toner supply element 59 and a toner concentration sensor 58, etc. integrated in it, and a driver 612 for driving the DC motor 611 according to the control by the CPU 613.

When the bottom is detected, the count is renewed at every interrupt with the constant period Ts by the counter 614*a*, and when the timing retard Td is reached, the output from the toner concentration sensor 58 is digitized by the AD converter 616. The RAM 614 performs software process of the digitized toner concentration value to compute the ON period of the DC motor 611 in order to exert ON/OFF control by the port output. The driver 612 drives the DC motor 611 in response to the ON/OFF output to control the toner supply element for supplying toner. It is more desirable to use a speed-controlled motor such as governor motor, etc. for the DC motor 611, for with such a motor supplying rate is kept constant. The CPU 613 is not necessarily required to integrate the RAM 614, timer 615, and AD converter 616. It is also suitable to compose them outside the CPU 613.

Figure 9:
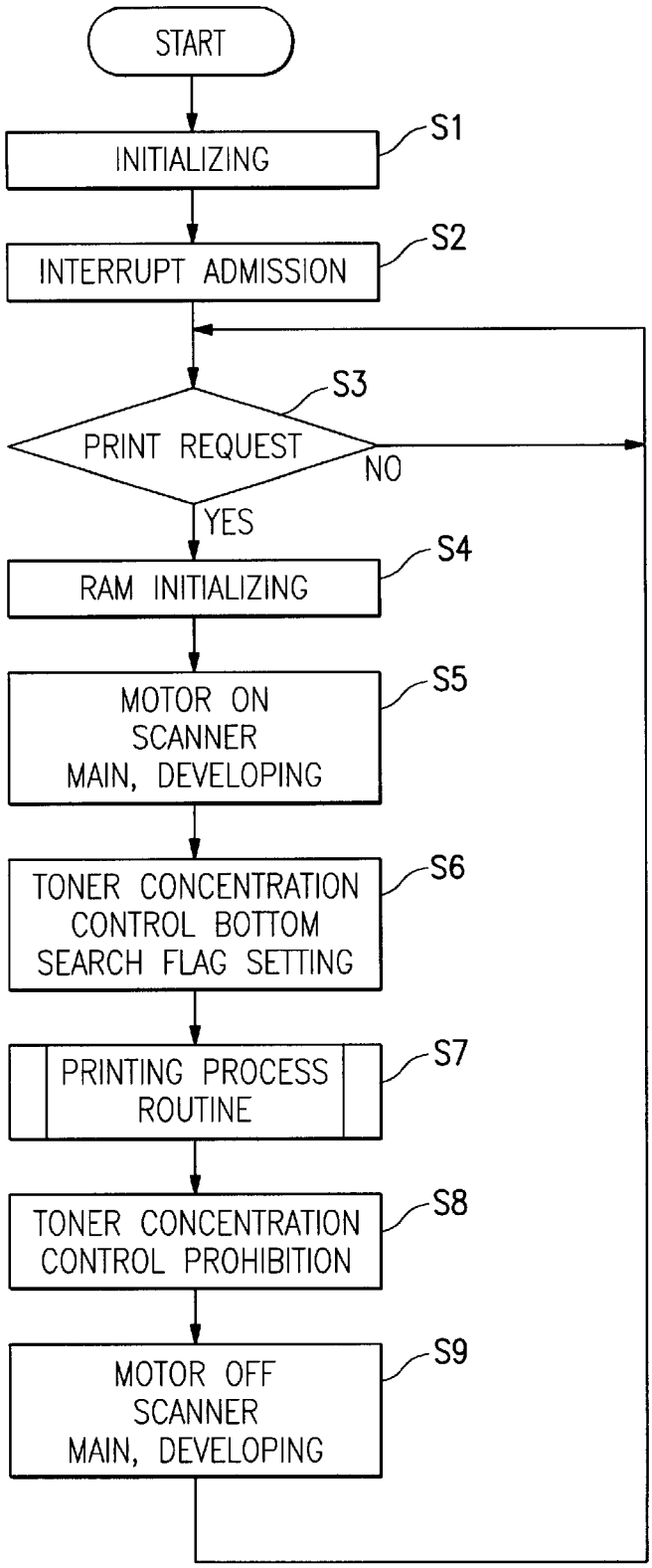
FIG. 9 is a flow chart showing the overall control of toner concentration according to an embodiment of the present invention.
Figure 10:
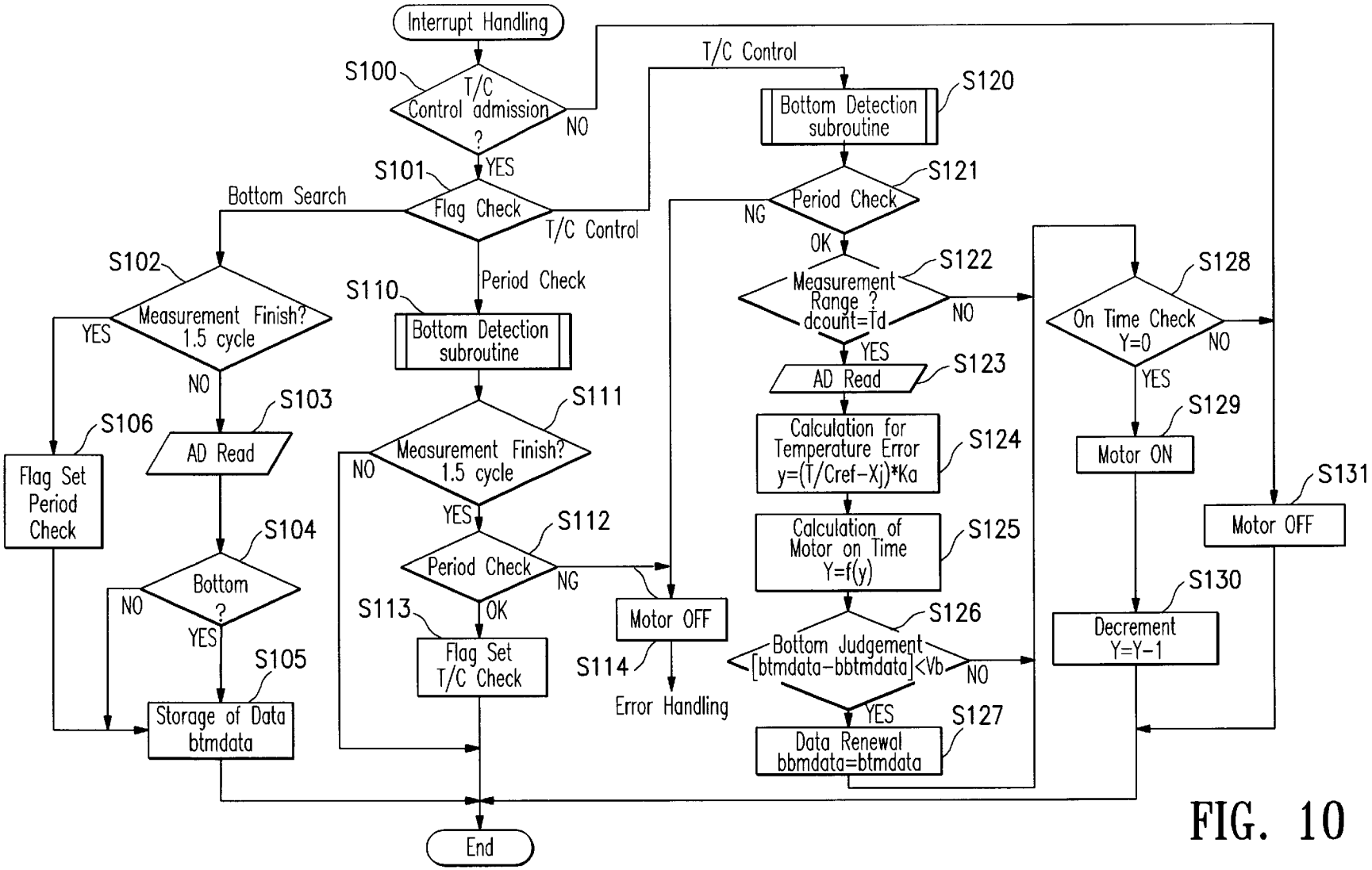
FIG. 10 is a flow chart showing the interrupt handling routine for the measurement of toner concentration according to an embodiment of the present invention.
Figure 11:
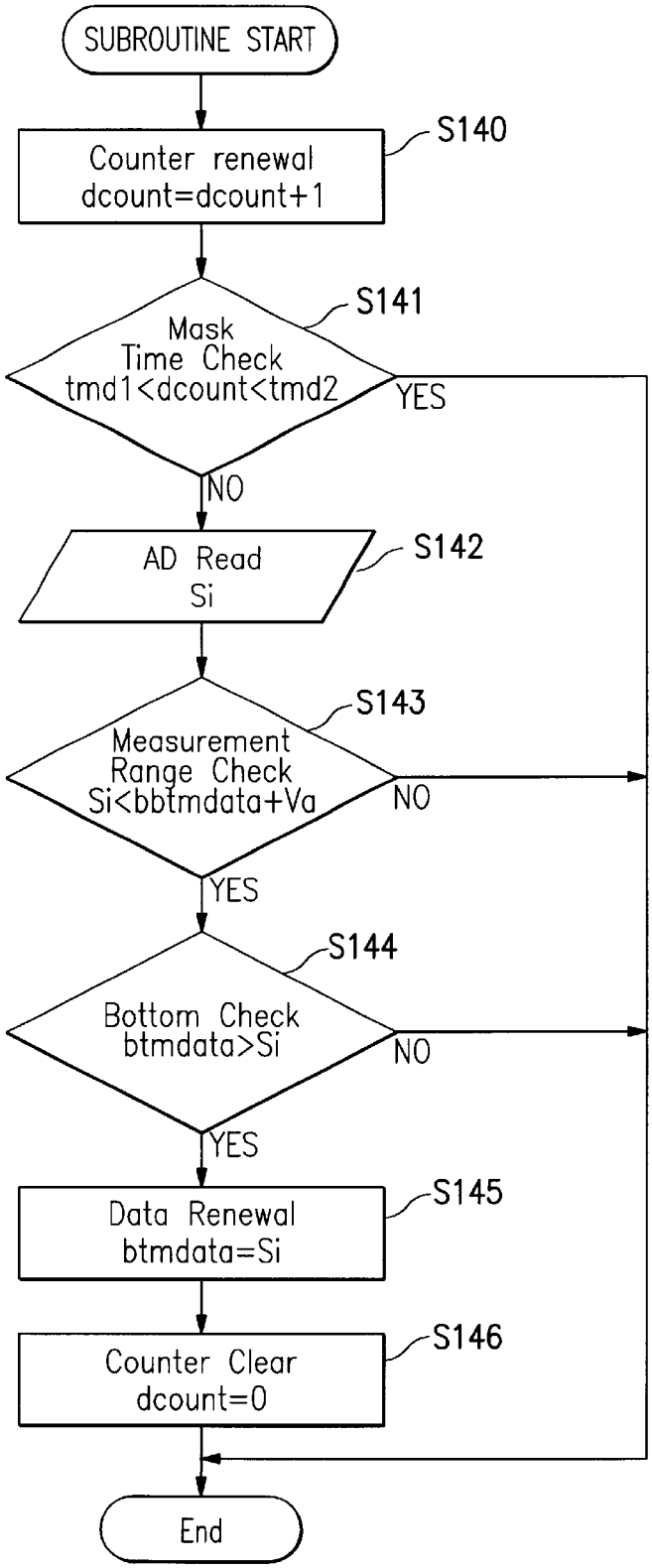
FIG. 11 is a flow chart showing the subroutine for detecting the bottom in the interrupt handling according to an embodiment of the present invention.

Next, the flow of control of the present invention will be explained with reference to FIG. 9, FIG. 10, and FIG. 11. FIG. 9 is a flow chart showing the overall control of toner concentration according to the present invention. FIG. 10 is a flow chart showing the measurement of toner concentration according to the present invention. FIG. 11 is a flow chart showing a subroutine used in interrupt handling.

After turning the power on, the CPU 613 executes initialization such as clearing and setting of initial values of the RAM 614 and setting of the timer 615 (S1), admits interrupt signal (S2), then waits for print request(S3). When the print request signal is produced, variables of the RAM 614 are initialized; the sheet scanner(in the case of copying machine), main motor, developer motor (all of them are not shown) are switched on to rotate; and the bottom search flag for toner concentration control is set and toner concentration control is admitted (S4~S6).

Subsequently, transferring to printing process routine (S9) and printing is carried out for each print request, while the DC motor 611 for supplying toner is switched off during the implementation of printing (S9).

Next, the flow chart for measuring toner concentration in the interrupt handling in the case printing is not requested (S3), will be explained with reference to FIG. 10.

Whether the control of toner concentration is admitted or not is checked (S100), and if the control is not admitted, the interrupt handling is finished while the DC motor 611 is left switched off. When the interruption is permitted, the flag is checked (S0101) and subsequent process is executed according to the flag.

When the flag shows bottom search, whether the measuring time of search is finished or not is checked (S102), and if not finished the output of the toner concentration sensor is converted to the digital value by the AD converter 616 (S103). Whether the digitized output of the toner concentration sensor is the bottom value or not is checked (S104), and if it is the bottom value the digitized output value of the toner concentration sensor 58 is stored (S105) in the RAM 614 as a variable btmdata, if it is not the bottom value the process S105 is passed. If the measuring time of search is finished (S102), the flag is shifted to period check (S106) and bottom search is finished.

Next, when the flag is shifted to period check, bottom detection subroutine is called (S110). Subsequently, whether measuring time of bottom search is finished or not is checked (S111), and skipped if not finished. About the period check, as the retard counter in the RAM 614 increases the number of counting in succession if the bottom is not found, whether the measured bottom is proper or not can be judged by whether the total sampling time of the number n of sampling with the sampling period Ts exceeds the scraping period Tc (S112). In this case, the number n of sampling period in one cycle of scraping is previously set in the RAM 614 and the actual number of sampling is compared with the set number. If judged as an error, that is, when the number of sampling exceeds the set number, the toner supplying motor is switched of to stop its rotation and error handling routine is executed (S114). By this, whether the estimation of the bottom was proper or not, whether the toner concentration sensor is out of order or not, whether proper oscillating waveform is not generated due to breakdown of the scraper 56*a* or not, or whether the developing device is not mounted or not, is judged. The error handling includes a retry process. In the case an error occurs in the period check even when retry is tried, it may be judged that the toner concentration is out of order, proper oscillating waveform is not generated due to breakdown of the scraper 56*a*, or the developing device is not mounted.

Next, when the flag (S101) shows toner concentration control, bottom detection subroutine is called (S120). Then period check (S121) similar to S111 is done, and if the period is judged to be proper, whether the present time is in the T/C detection timing retard Td or not, that is, whether now is the time to read toner concentration or not is investigated (S122). If it is the time to read, the output of the toner concentration 58 digitized by the AD converter 616 is read (S123), subsequently, the difference between the read value and the reference value T/Cref is obtained, and a feedback quantity y is determined by multiplying feedback gain Ka (S124). The feedback quantity y is converted to an ON time of the DC motor 611 of the toner supply element 59, upper and lower limit is applied to the ON time to get ON time Y of the DC motor 611 (S125). It is suitable, when it is the time to read, to execute a plurality of sampling to read a plurality of values to average them. After each process is finished, retard counter in the RAM 614 is cleared(S126). Then renewal judgement of the bottom data is performed (S126), wherein judgement is done if the bottom data of this time is reliable or not according to whether the absolute value of the difference between the bottom data of this time btmdata and that of last time btmdata is smaller than the judgement value Vb or not. When the difference is smaller than the judgement value judgement Vb, renewal of the bottom data in the RAM 614 is done (S127). If the difference is larger than the judgement value Vb, renewal is not done and the data stored last time remains. Then judgement on ON time of the toner supply motor is made (128). The driving of the DC motor 611 for toner supplying is decided whether the ON time Y is above zero or not. When Y is above zero, the toner supply motor is switched on (S129) and Y value in the RAM 614 is decreased until Y is zero (S130). When Y is zero or below, the DC motor 611 for supplying toner is switched off (S131). The ON time Y of the DC motor 611 for supplying toner can be set by an interval of the sampling period Ts.

Next, the flow chart of the subroutine for detecting bottom in the interrupt process will be explained with reference to FIG. 11.

At first, the retard counter in the RAM 614 is renewed (S140), then whether the present time is in the mask time or not is judged by comparing the present time with the values tmd1 and tmd2 which are preset in the RAM 614 (S141). The preset values tmd1 and tmd2 may be stored in another ROM or in an outside memory not shown in FIG. 8. When the present time belongs to the mask time, the flow is skipped, if not so, the output of the toner concentration sensor is digitized by the AD converter 616 (S142). The digitized output Si of the toner concentration sensor is compared with the sum of the bottom data bbtmdata of the last detection written in the RAM 614 and the predetermined value Va in the RAM 614 in order to judge whether the output Si is a value belonging to the measuring range or not (S143). If judged that it is not, the flow is skipped and if judged it is, then the evaluation is done whether the output Si of the toner concentration sensor is larger or smaller than the bottom data btmdata written in the RAM 614 (S144). If the output Si of the toner concentration is larger, the flow is skipped, if smaller, the bottom data btmdata written in the RAM 614 is renewed by the output Si of the toner concentration sensor read this time (S145). Then the retard counter in the RAM 614 is cleared (S146).

As has been described in the foregoing, according to the embodiment of a toner concentration control device, following effects are obtained by the configuration describe above:

(1) The timing of measurement of toner concentration is always constant by detecting the concentration after a constant time from the time when the output of a toner concentration detection means is at minimum, positive toner concentration detection is possible, and the control of toner concentration by which an image of satisfactory quality is attainable is possible.

(2) Stagnation of developer and adhesion of toner in the proximity of a toner concentration sensor are eliminated, stable measurement of toner concentration in an extended period of time is possible, and stable measurement of toner concentration without influenced by the shape of a developer stirring mixer rib and the mounting position of the toner concentration detecting sensor is possible, resulting in a stable control of toner concentration.

(3) A stable measurement of toner concentration without influenced by the variation of the environment is possible resulting in a stable control of toner concentration, and a product with high reliability without influenced by the variation in accuracy of constituent parts and mounting can be provided.

(4) According to the present invention, a stirring and scraping mixer ( primary mixer) which functions as a waveform generating means is composed of a scraper having a spiral projections provided on the periphery of an outer mixer, a part of one of the spiral projections being different in height from the remaining part to make it to have a scraping function, not composed of a scraper of sponge, etc., and the developer accumulated on the surface of a toner concentration detection means is compressed by the other spiral projection provided on the primary mixer with a phase difference to the said one of the projections, and parts which impair the flow of toner in the axial direction is eliminated, so the scraping of the detecting face of the permeability sensor is performed without reducing the performance of agitation resulting in a positive measurement of toner concentration and smooth and uniform mixing by stirring in a short period of time, and an image of satisfactory quality can be attained.

(5) Particularly, according to the present invention, as the spiral projections are provided continuing on the whole periphery of a hollow cylindrical body, the reduction of stirring performance due to impaired flow of the developer in the axial direction is eliminated. Further, as the spiral projection having scraping function is replaceable, it can be replaced in the case of wear or damage for any cause. Also, by allowing the distance between the tip of the spiral projection and the detecting face of the toner concentration detecting sensor to be equal to or smaller than 1 mm, preferably equal to or smaller than 0.5 mm, more positive scraping of the developer is possible.

What is claimed is:

1. A toner concentration control device comprising:

a toner concentration detection means for detecting magnetically a toner concentration information of a toner in a developer vessel, the developer vessel storing a developer composed of a carrier and the toner;

a toner supply means for supplying the developer based on the output of the toner concentration information;

a wave-forming means for forming a wave of decreasing output of the toner concentration detection means reduced through periodically scraping off the toner on a detecting face of the toner concentration detection means;

an about-minimum value detection means for detecting the minimum or its vicinity of the descending output reduced by the wave-forming means;

wherein a toner concentration detection retarding means is actuated from the time the minimum value or its vicinity is detected, wherein the toner supply means is actuated based on the detected toner concentration information after the toner concentration detection retarding means is released of action; and wherein the toner concentration detection means includes a waveform measuring means which measures the output of the toner concentration detection means over a predetermined period longer than the period of one cycle of a scraping cycle, and an about-minimum value judging means which determines the minimum or its vicinity of the output value measured by the waveform measuring means; and the toner concentration determining means is actuated based on the value judged as the minimum or its vicinity the about-minimum judging means before the toner supply means is actuated.

2. A toner concentration control device according to claim 1, wherein a detection range determined from the minimum value or its vicinity detected by the about-minimum value detection means in the preceding cycle is provided beforehand, and the about-minimum value detection means determines the minimum value or its vicinity in the cycle concerned from the output of the toner concentration detection means in the said detection range.

3. A toner concentration control device according to claim 2, wherein the minimum value or its vicinity detected by the about-minimum value detection means and the minimum value or its vicinity detected by the about-minimum value detection means in the preceding cycle are evaluated on the basis of the predetermined value for judgement, and when the result of judgement is out of the judgement criteria, the minimum value or its vicinity detected by the about-minimum value detection means in the preceding cycle is used without replacing it by the value detected by the about-minimum value detection means in the cycle concerned.

4. A toner concentration control device according to claim 2, wherein a toner concentration detection prohibiting means which prohibits the detection of toner concentration for a proper period is provided together with the about-minimum value detection means, the prohibiting means sets a detection prohibiting period from the point of the minimum value or its vicinity detected by the about-minimum value detection means to prohibit the detection of the toner concentration during the period.

5. A toner concentration control device according to claim 1, wherein a detection range determined from the minimum value or its vicinity judged by the about-minimum value detection means is provided beforehand, and the about-minimum value detection means determines the minimum value or its vicinity from the output of the toner concentration detection means in the said detection range.

6. A toner concentration control device according to claim 5, wherein a toner concentration detection prohibiting means which prohibits the detection of toner concentration for a proper period is provided together with the about-minimum value detection means, the prohibiting means sets a detection prohibiting period from the point of the minimum value or its vicinity detected by the about-minimum value detection means to prohibit the detection of the toner concentration during the period.

7. A toner concentration control device according to claim 1, wherein the minimum value or its vicinity detected by the about-minimum value detection means and the minimum value or its vicinity detected by the about-minimum value detection means in the preceding cycle are evaluated on the basis of the predetermined value for judgement, and when the result of judgement is out of the judgement criteria, the minimum value or its vicinity detected by the about-minimum value detection means in the preceding cycle is used without replacing it by the value detected by the about-minimum value detection means in the cycle concerned.

8. A toner concentration control device according to claim 7, wherein a toner concentration detection prohibiting means which prohibits the detection of toner concentration for a proper period is provided together with the about-minimum value detection means, the prohibiting means sets a detection prohibiting period from the point of the minimum value or its vicinity detected by the about-minimum value detection means to prohibit the detection of the toner concentration during the period.

9. A toner concentration control device according to claim 1, wherein a toner concentration detection prohibiting means which prohibits the detection of toner concentration for a proper period is provided together with the about-minimum value detection means, the prohibiting means sets a detection prohibiting period from the point of the minimum value or its vicinity detected by the about-minimum value detection means to prohibit the detection of the toner concentration during the period.

10. A toner concentration control device according to claim 1, wherein a period judging means for detecting and judging the period of the waveform of toner concentration for a proper period is provided together with the about minimum value judging means and about-minimum value detection means, the about-minimum value detection means is activated on the basis of the value judged as the minimum value or its vicinity by the about-minimum value judging means, and the toner supply means is actuated when the period of the waveform of toner concentration is judged proper by the period judging means.

11. A toner concentration control device according to claim 1, wherein a variation judging means which detects and judges the defined variation of the output of the toner concentration detection means is provided together with the about-minimum value detection means, and the actuation of the toner supply means is prohibited when the defined variation of the output of the toner concentration is judged as abnormal by the variation judging means.

12. A toner concentration control device according to claim 1, wherein the wave-forming means is a mechanical stirring means for mixing by stirring the developer with spiral projections provided on the periphery of a rotating hollow cylindrical body.

13. A toner concentration control device according to claim 12, wherein the mechanical stirring means has spiral projections differing in phase by a constant angle, the height of a part of each projections, the axial position of the parts corresponding to the position of the toner concentration detection means, is different from that of the remaining part of the spiral projections to allow the one part to work as a scraper for scraping off the developer on the detecting face of the toner concentration detection means and another part to work for compressing the developer on the detecting face of the toner concentration detection means, and the toner concentration detection means detects the toner concentration when the developer is compressed to control toner concentration.

14. A toner concentration control device according to claim 13, wherein each spiral projection is provided con tinuing on the periphery of the hollow cylindrical body including the scraper part.

15. A toner concentration control device according to claim 13, wherein the part of the spiral projection functioning as scraper is attached exchangeable to the hollow cylindrical body.

16. A toner concentration control device according to claim 13, wherein a gap between the tip of the scraper part of the spiral projection and detecting face of the toner concentration detection means is set to be 1 mm or smaller.

* * * * *